US007435920B1

(12) United States Patent
Yoo

(10) Patent No.: US 7,435,920 B1
(45) Date of Patent: Oct. 14, 2008

(54) AUTOMATIC TRANSFER SWITCH WITH DOUBLE THROW AIR CIRCUIT BREAKER

(75) Inventor: Ki-Hyun Yoo, Gwangju-si (KR)

(73) Assignee: Hancess Co., Ltd., Seoul (KR)

( * ) Notice: Subject to any disclaimer, the term of this patent is extended or adjusted under 35 U.S.C. 154(b) by 0 days.

(21) Appl. No.: 11/829,754

(22) Filed: Jul. 27, 2007

(51) Int. Cl.
*H01H 9/26* (2006.01)

(52) U.S. Cl. ..... 200/50.32; 200/50.33; 307/64

(58) Field of Classification Search ..... 200/400, 200/401, 500, 501, 17 R, 18, 50.32–50.37; 307/125, 65, 116, 64; 361/90; 363/34, 37; 335/11, 13
See application file for complete search history.

(56) References Cited

U.S. PATENT DOCUMENTS 3,936,782 A * 2/1976 Moakler et al. ..... 335/161
4,021,678 A * 5/1977 Moakler et al. ..... 307/64
4,157,461 A * 6/1979 Wiktor ..... 200/18
4,398,097 A * 8/1983 Schell et al. ..... 307/64
5,023,469 A * 6/1991 Bassett et al. ..... 307/64
5,070,252 A * 12/1991 Castenschiold et al. ..... 307/64
5,576,604 A * 11/1996 Kunert et al. ..... 318/135
5,638,948 A * 6/1997 Sharaf et al. ..... 200/401
6,100,604 A * 8/2000 Morroni et al. ..... 307/64
6,765,157 B2 * 7/2004 Rademacher et al. ..... 200/1 R
6,815,622 B2 * 11/2004 Milman et al. ..... 200/5 R
6,815,624 B2 * 11/2004 Schultz ..... 200/50.33

* cited by examiner

*Primary Examiner*—Michael A Friedhofer
(74) *Attorney, Agent, or Firm*—Birch, Stewart, Kolasch & Birch, LLP

(57) ABSTRACT

An automatic transfer switch with a double throw air circuit breaker is disclosed, which consists of a unit able to automatically disconnect a preparatory power when a contact point is connected with a commercial power and able to automatically disconnect a commercial power when it is connected with a preparatory power and a unit able to concurrently disconnect a commercial power and an emergency power, and a unit for automatically connecting a contact point.

6 Claims, 10 Drawing Sheets

AUTOMATIC TRANSFER SWITCH WITH DOUBLE THROW AIR CIRCUIT BREAKER

TECHNICAL FIELD

The present invention relates to an automatic transfer switch which is made by providing an interlock device and a housing on the outer body sides of two air circuit breakers (ACB) which use two type powers supplied from different power supply sources in a large size building or a factory which uses a large size power.

BACKGROUND ART

An automatic transfer switch is used for selectively connecting a preparatory power to a load side with the preparatory power being used when a commercial power has a problem. The automatic transfer switch consists of an air circuit breaker which automatically disconnects a commercial power when a commercial power has a problem, and another air circuit breaker which automatically disconnects an emergency power.

So, as shown in FIG. 1, a connection and disconnection are separately performed between the commercial power and the preparatory power in the conventional automatic transfer switch.

When a commercial power has a problem, a preparatory power should be connected at the time when a commercial power is disconnected for a reliable power supply. However, the connection and disconnection in the conventional automatic transfer switch are separately performed, so that it is impossible to fast and reliably supply power. Since the air circuit breaker should be separately provided for a commercial power and a preparatory power, respectively, it costs too much, and the installation area disadvantageously increases.

When a manufacturing facility, which operates with power, is damaged or has a problem, it is needed to disconnect both the commercial power and the emergency power. In this case, since the commercial power and the preparatory power are separately controlled, it is impossible to concurrently disconnect the commercial power and the preparatory power. When the contact points of a commercial power or emergency power are connected, a handle is installed at an automatic transfer switch is manually operated. Here, since each handle is operated with a manual force, it is not easy to properly operate the handles. There are many potential error portions such as in a connection state of an external interlock and a housing.

DISCLOSURE OF THE INVENTION

Accordingly, it is an object of the present invention to provide an automatic transfer switch which overcomes the problems encountered in the conventional art.

It is another object of the present invention to provide an automatic transfer switch with a double throw air circuit breaker which consists of a unit able to automatically disconnect a preparatory power when a contact point is connected with a commercial power and able to automatically disconnect a commercial power when it is connected with a preparatory power, and a unit able to concurrently disconnect a commercial power and an emergency power, and a unit for automatically connecting a contact point. With the above construction, a manufacturing cost of an automatic transfer switch decreases, and it is easy to use, and an emergency power can be fast connected when a commercial power has a problem for thereby reliably supplying power In case of an emergency situation, a commercial power and an emergency power can be concurrently disconnected fast and easily.

To achieve the above objects, in an automatic transfer switch which includes ratchet gears rotating by means of an operation of a handle, connection rods which operate in sync with the ratchet gears with one side of each of the same being connected with shafts having a plurality of connection units, springs which are installed at the connection rods, a switching unit which is connected with the commercial power connection unit and the preparatory power connection unit wherein when it is connected with one of the connection units, the other connection unit is disconnected, and a trip unit which is connected with the commercial power connection unit and the emergency power connection unit and allows a neutral state by disconnecting the connection units, there is provided an automatic transfer switch with a double throw air circuit breaker which comprises a motor which is engaged at a lower end of a body with an eccentric roller being formed at a front end of a rotary shaft; an automatic rotation unit which operates by receiving a power via an arm having latches at both sides of the same and rotates the ratchet gears, with a longitudinal hole, which accommodates the eccentric roller therein, being formed at one side of the same, with the other side of the same being engaged with the ratchet gears; and insulators which are engaged on the shafts, with connection units being engaged at the front sides of the same.

BRIEF DESCRIPTION OF THE DRAWINGS

The present invention will become better understood with reference to the accompanying drawings which are given only by way of illustration and thus are not limitative of the present invention, wherein.

MODES FOR CARRYING OUT THE INVENTION

The construction and operations of the present invention will be described with reference to the accompanying drawings.

Figure 2:
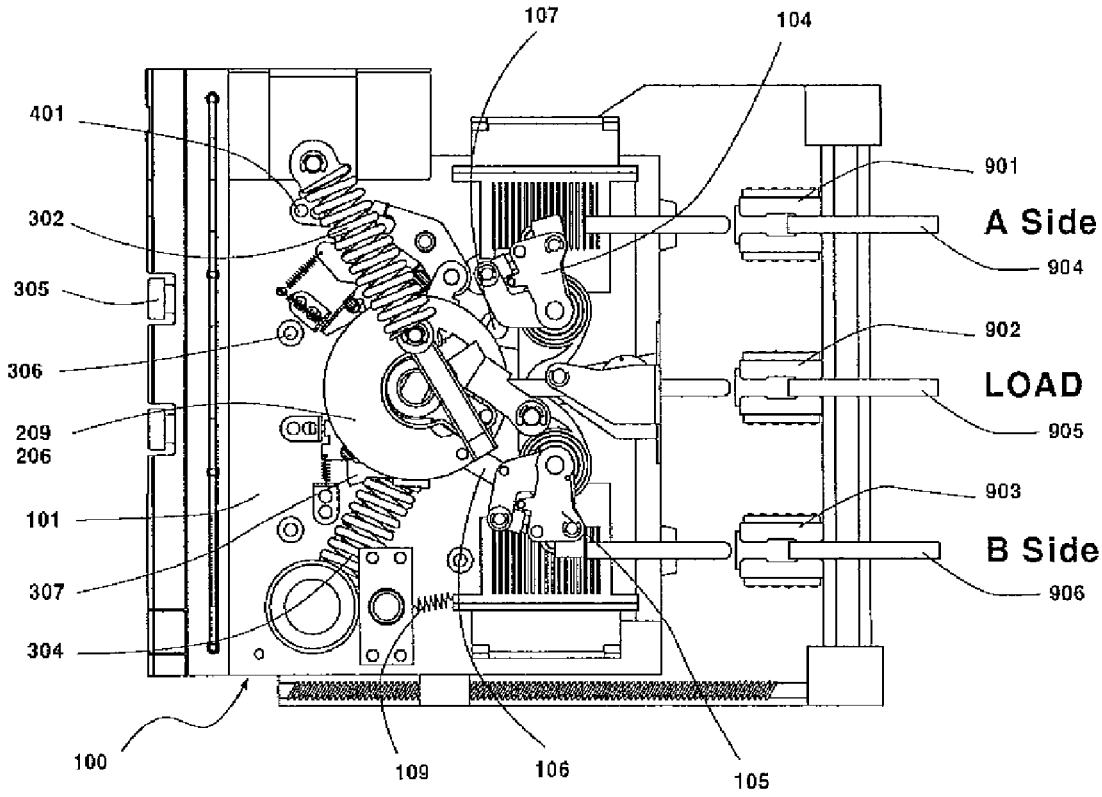
FIG. 2 is a side view illustrating an automatic transfer switch according to the present invention.
Figure 3:
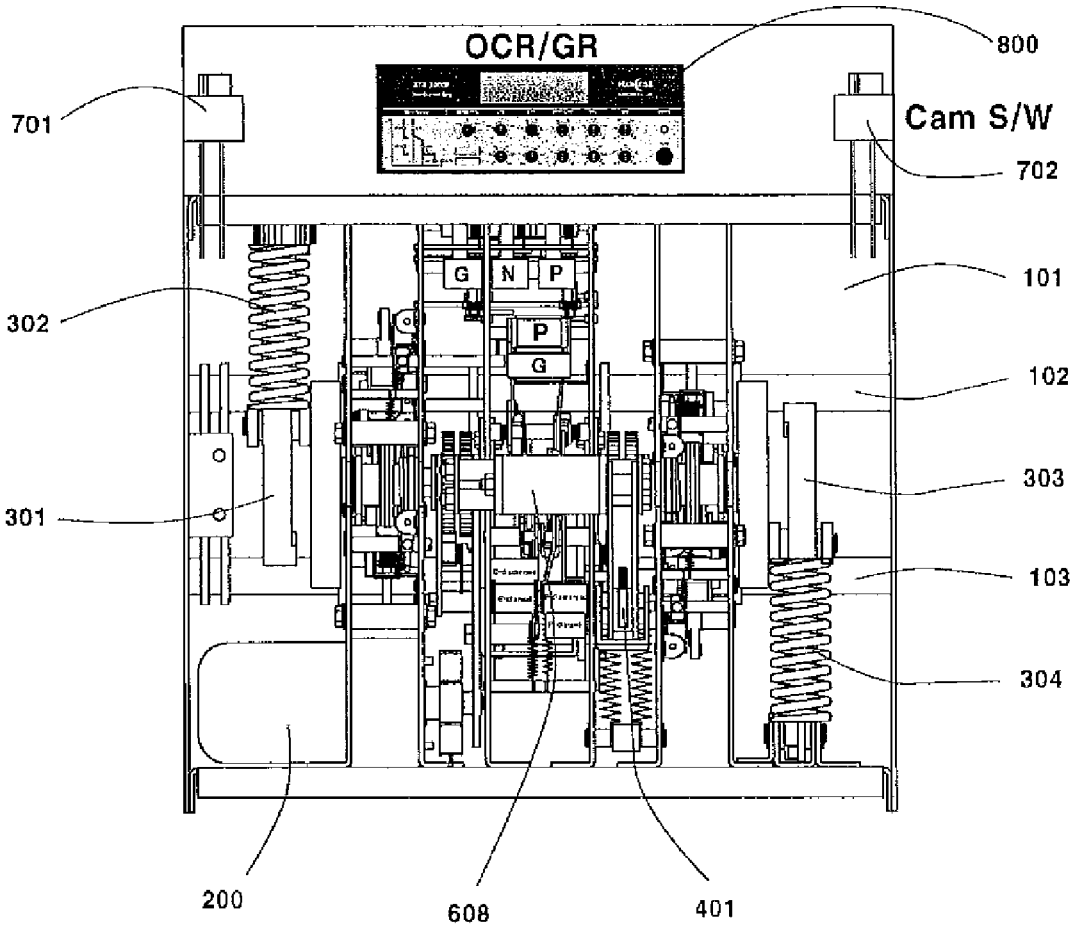
FIG. 3 is a front view illustrating an automatic transfer switch according to the present invention.
Figure 4:
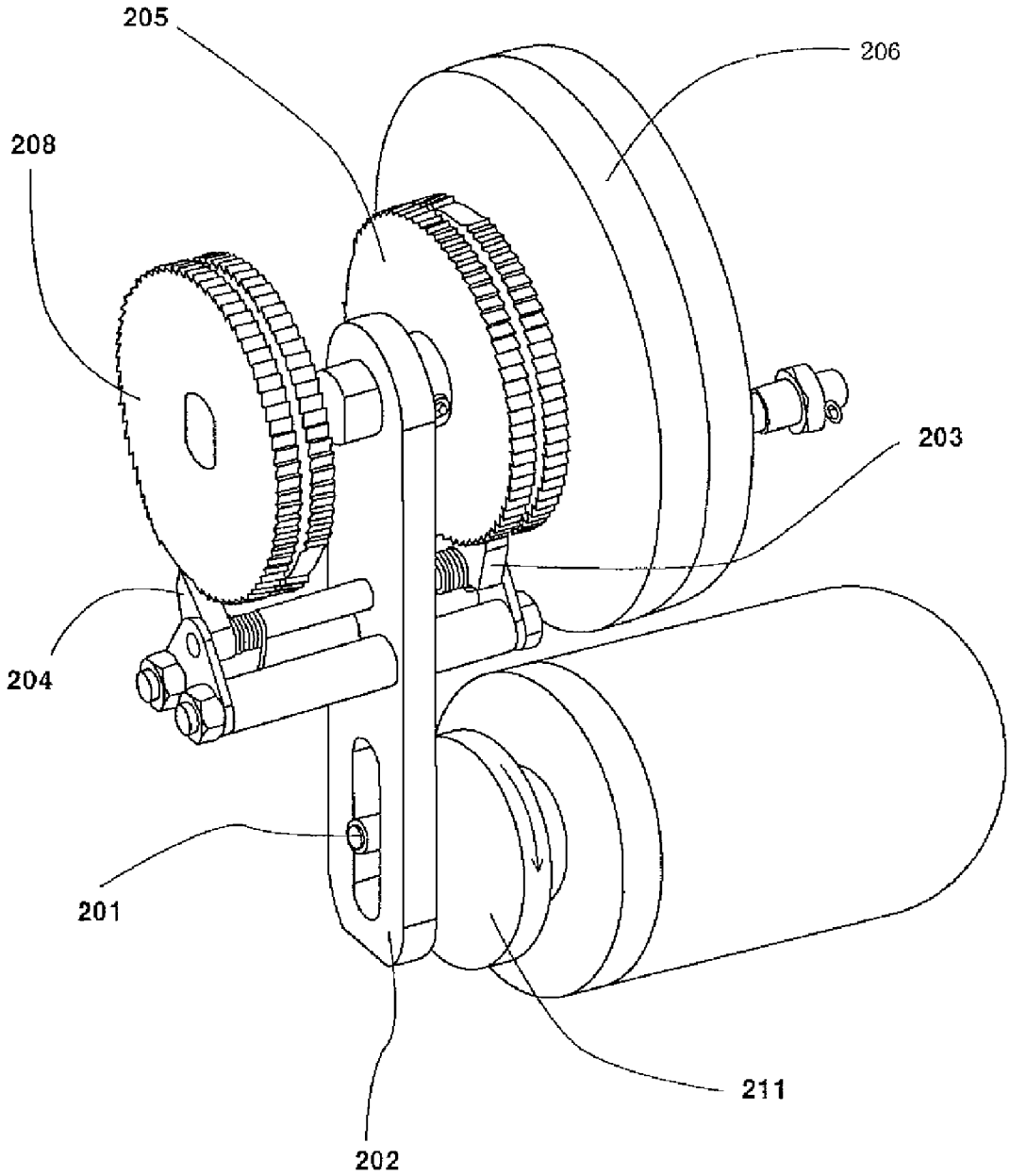
FIG. 4 is a view illustrating an automatic rotation unit according to the present invention.
Figure 5:
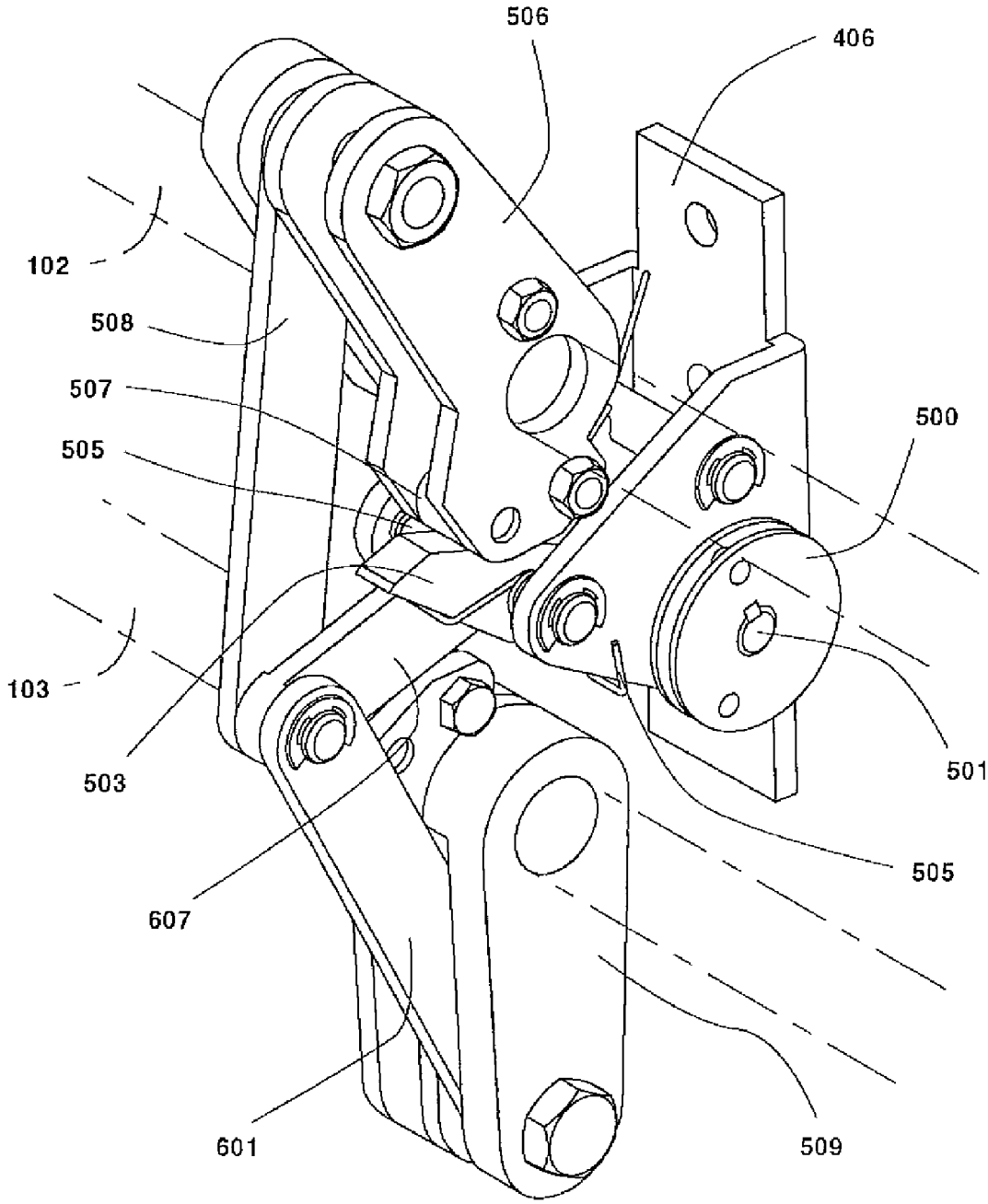
FIG. 5 is a view illustrating a trip unit according to the present invention.

FIG. 2 is a side view illustrating an automatic transfer switch according to the present invention. FIG. 3 is a front view illustrating an automatic transfer switch according to the present invention. FIG. 4 is a view illustrating an automatic rotation unit according to the present invention. FIG. 5 is a view illustrating a trip unit according to the present invention.

Figure 6:
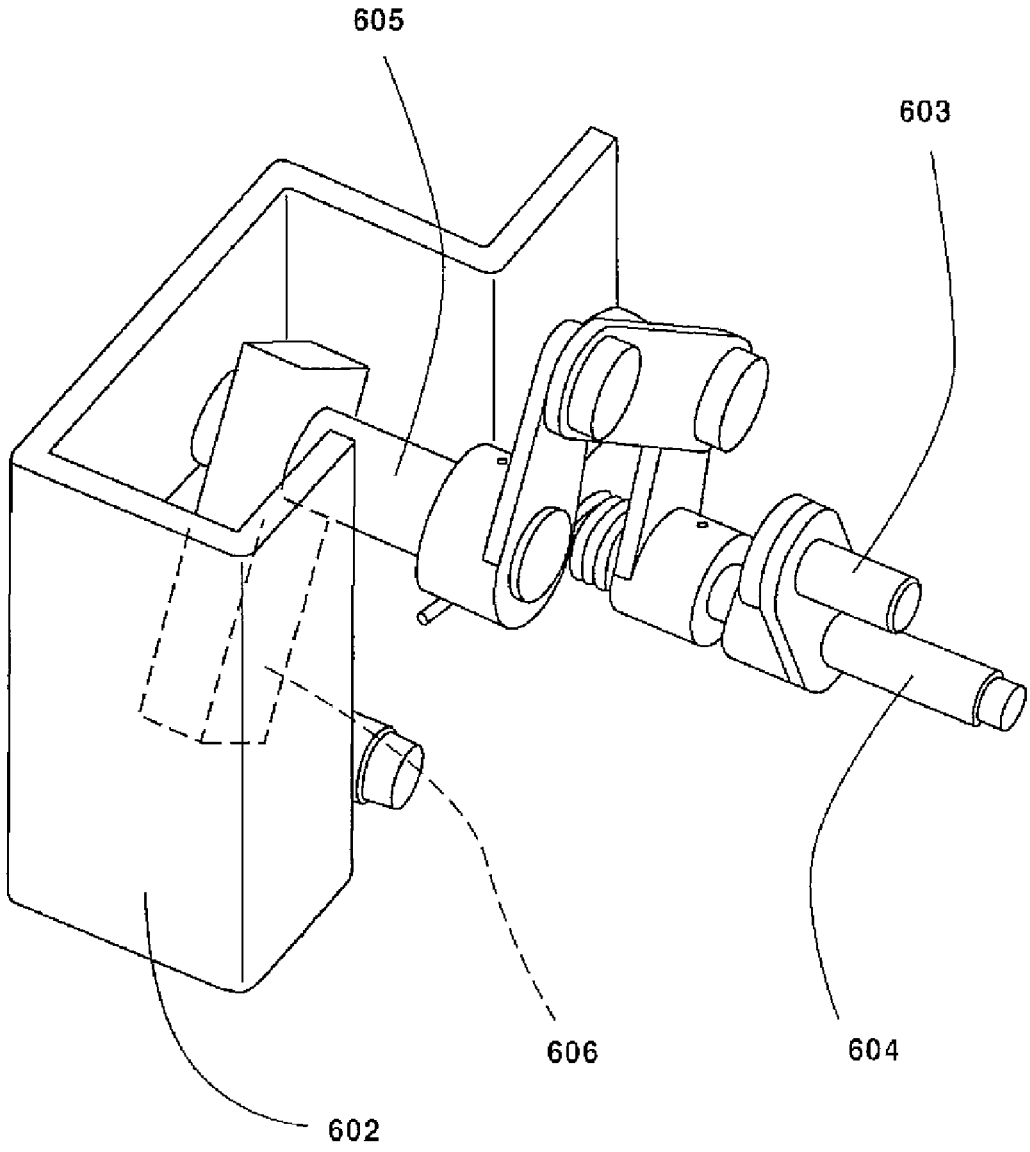
FIG. 6 is a view illustrating a switching unit according to the present invention.
Figure 7:
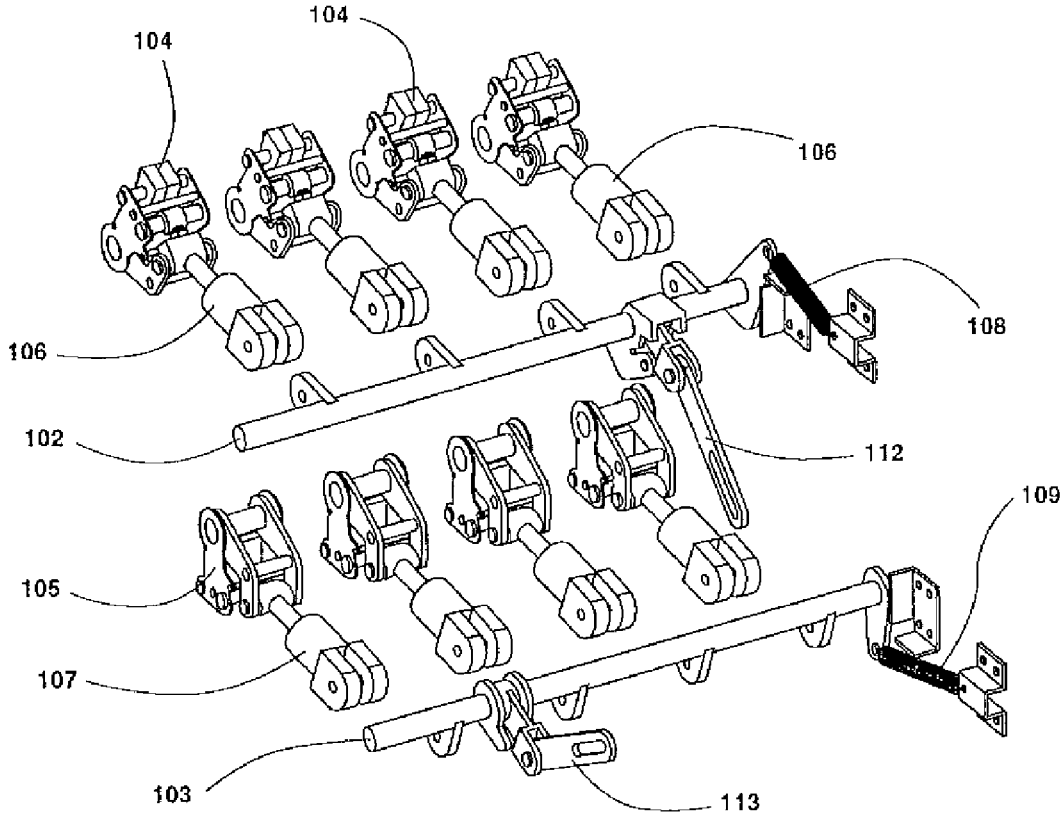
FIG. 7 is a perspective view illustrating a connection unit according to the present invention.
Figure 8:
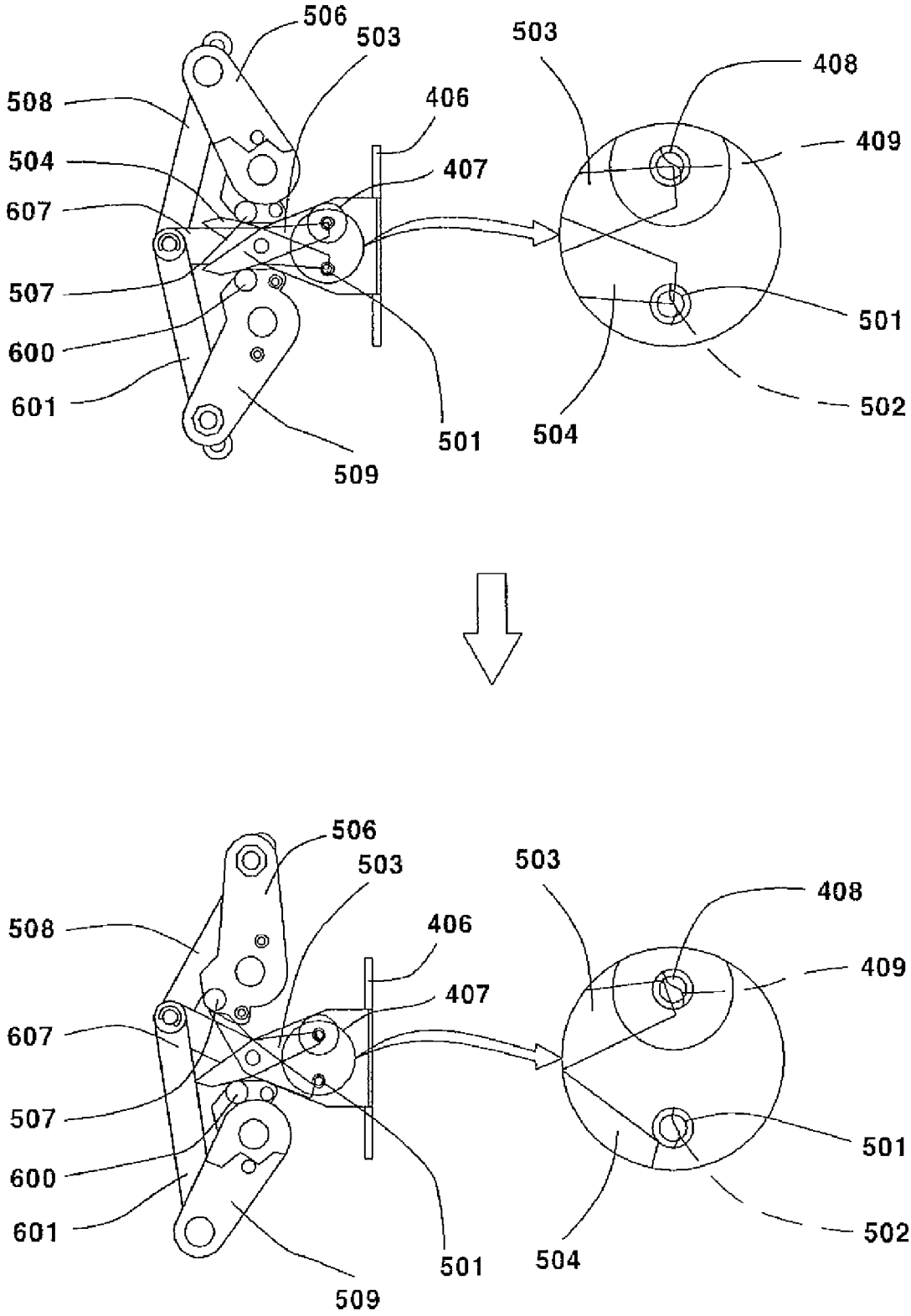
FIG. 8 is a view illustrating an operation state that a commercial power is tripped according to the present invention.
Figure 9:
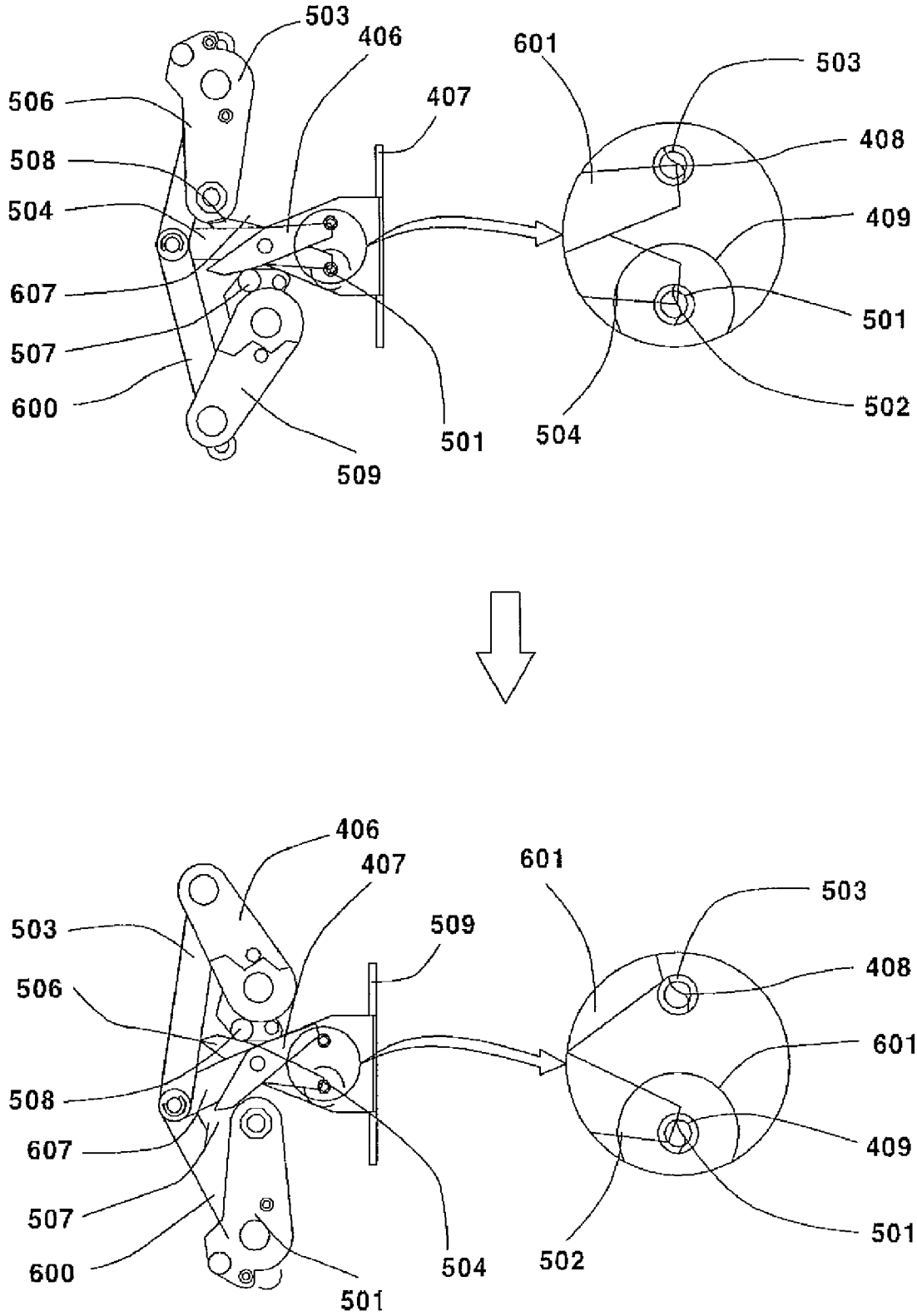
FIG. 9 is a view illustrating an operation state that a preparatory power is tripped according to the present invention.
Figure 10:
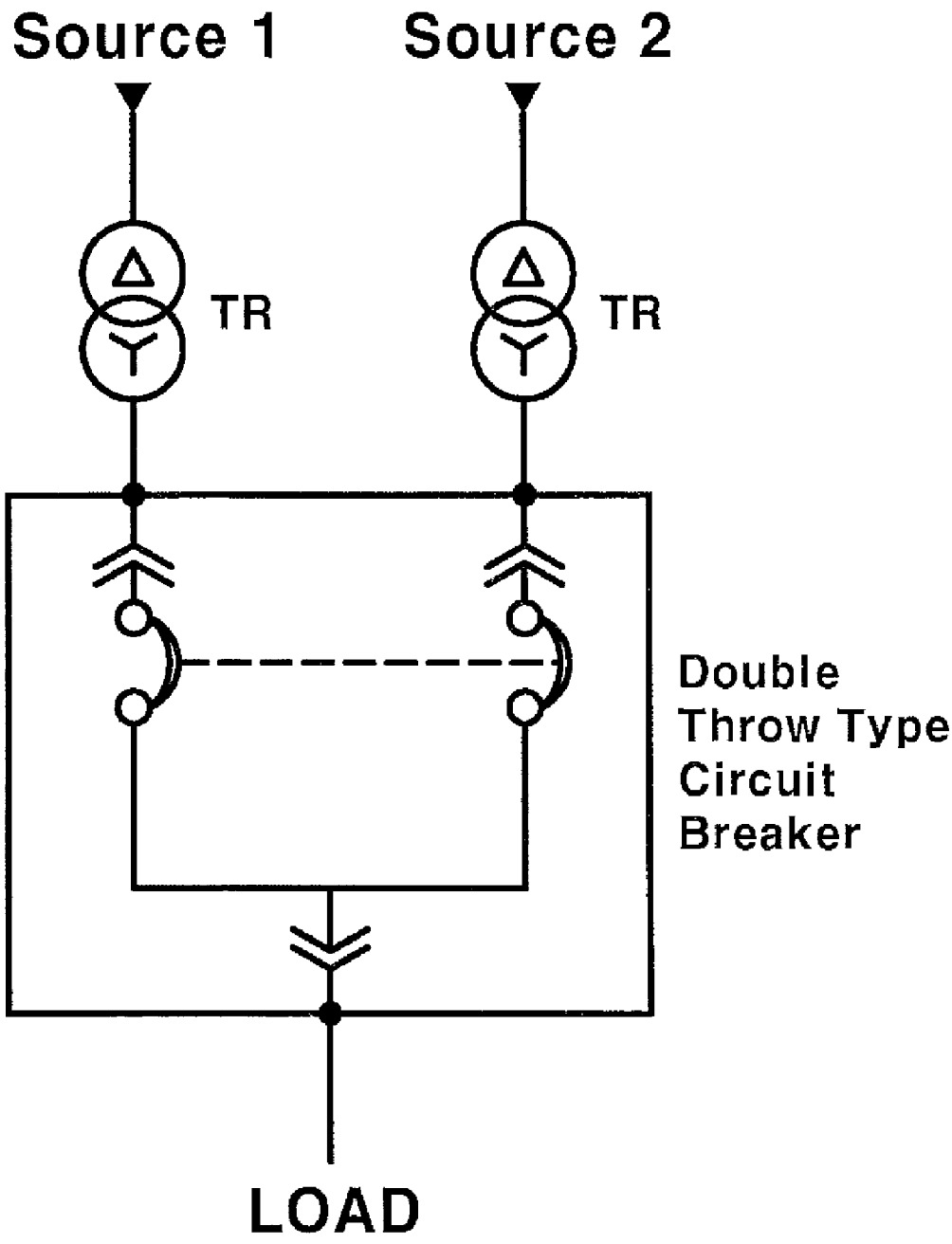
FIG. 10 is a circuit diagram illustrating an automatic transfer switch according to the present invention.

FIG. 6 is a view illustrating a switching unit according to the present invention. FIG. 7 is a perspective view illustrating a connection unit according to the present invention. FIG. 8 is a view illustrating an operation state that a commercial power is tripped according to the present invention. FIG. 9 is a view illustrating an operation state that a preparatory power is tripped according to the present invention. FIG. 10 is a circuit diagram illustrating an automatic transfer switch according to the present invention.

In the present invention, a plurality of insulators 106 and 107 are connected on a commercial power shaft 102 and a preparatory power shaft 103. A commercial power connection unit 104 and a preparatory power connection unit 105 are connected at the front ends of the insulators 106 and 107. There are provided a switching unit for selectively connecting either the commercial power or the preparatory power and tripping the other non-selected power, and a unit for concurrently tripping both the powers.

In a driving force supply apparatus for connecting or tripping the connection units 104 and 105, a motor 108 is installed at a lower side of a body 101, and an eccentric roller 201 is provided at a rotary shaft 109 of the motor. A commercial power wheel 209 and a preparatory power wheel 206 are provided at an intermediate portion of the body 101, and ratchet gears 205 and 208 are provided on the same axes of the commercial power wheel 209 and the preparatory power wheel 206. Engaging shoulders 207 and 300 are formed at the wheels 206 and 209. A longitudinal hole 202 is formed with one end of the same being engaged withy the ratchet gears 205 and 208, with the eccentric roller 201 being inserted into the other end of the same. An arm 202 having ratchets 203 and 204 at both sides of an intermediate portion of the arm is provided.

Connection rods 301 and 303 are engaged with springs 302 and 304 with one sides of the same being engaged with the body 101, with the bother sides of the same being engaged with the wheels 206 and 209. Connection units 301 and 303 are provided for connecting the shafts 102 and 103 and the wheels 206 and 209.

In the trip unit, a pressing unit 305 having protrusions 306 at both sides is installed at an upper side of the body 101 and rotates with respect to the rotary shaft 308. A rotation lever 307 of which an upper side contacts with the protrusion 306 and a lower side is engaged with the connection units 400 and 401 is provided for the commercial power and the preparatory power. There are provided a commercial power trip wheel 407 and an emergency power trip wheel 500 which are engaged at the trip shafts 408 and 501 having fixing grooves 409 and 502 with one side of each of the same being rotatably engaged with the connection units 400 and 401.

There are provided a commercial power operation unit 506 and a preparatory power operation unit 509 which are engaged with the shafts 102 and 103 with engaging shoulders 507 and 600 being formed at one side of each of the same, with connection bars 508 and 601 being formed at the other side of each of the same. There are provided engaging units 503 and 504 which are engaged with the bracket 406 with one side of each of the same being engaged at fixing grooves 409 and 502 of the trip shafts 408 and 501, with the other side of each of the same contacting with the engaging shoulders 507 and 600 of the operation units 506 and 509.

The front ends of the connection bars 508 and 601 are connected with the connection bar 607 which connects the bracket 406.

The switching unit is provided at both sides of the body 101 for a commercial power and a preparatory power. A pressing unit 405 having a protrusion 03 and a groove 404, and a preparatory power pressing unit 402 are provided at the upper side of the body 101. The protrusion 403 is inserted into the engaging groove 309 formed at the rotation lever 307. A rotation unit 603 is connected with a fixing shaft 604 installed at the bracket 602 and has a front end inserted into the groove 404 of the pressing units 402 and 405. An engaging lever 606 is installed on the lever shaft 605 connected with the fixing shaft 604 and limits the rotations of the wheels 206 and 209.

In the drawings, reference numeral 11 represents an automatic transfer switch according to the present invention, and 108 represents a spring for elastically supporting the commercial power shaft 102, and 109 represents a spring for elastically supporting the preparatory power shaft 103, and 505 represents a spring for elastically supporting the commercial power engaging unit 503 and the preparatory power engaging unit 504, and 608 represents a handle for manually rotating the ratchets 205 and 208.

The operations of the present invention will be described.

As power is supplied to the motor 200, the motor 200 starts operating. So, the rotation shaft 211 and the eccentric roller 201 of the motor 200 rotate. The arm 202 in which the eccentric roller 201 is inserted into the longitudinal hole 207 reciprocates forwards and backwards. The ratchet gears 205 and 208 and the wheels 206 and 209 rotate.

Since the ratchet gears 205 and 208 are engaged with the latches 203 and 204, they rotate in direction. Namely, they rotate in one direction same as the wheels 206 and 209 which rotate along with the ratchet gears 205 and 208.

Figure 1:
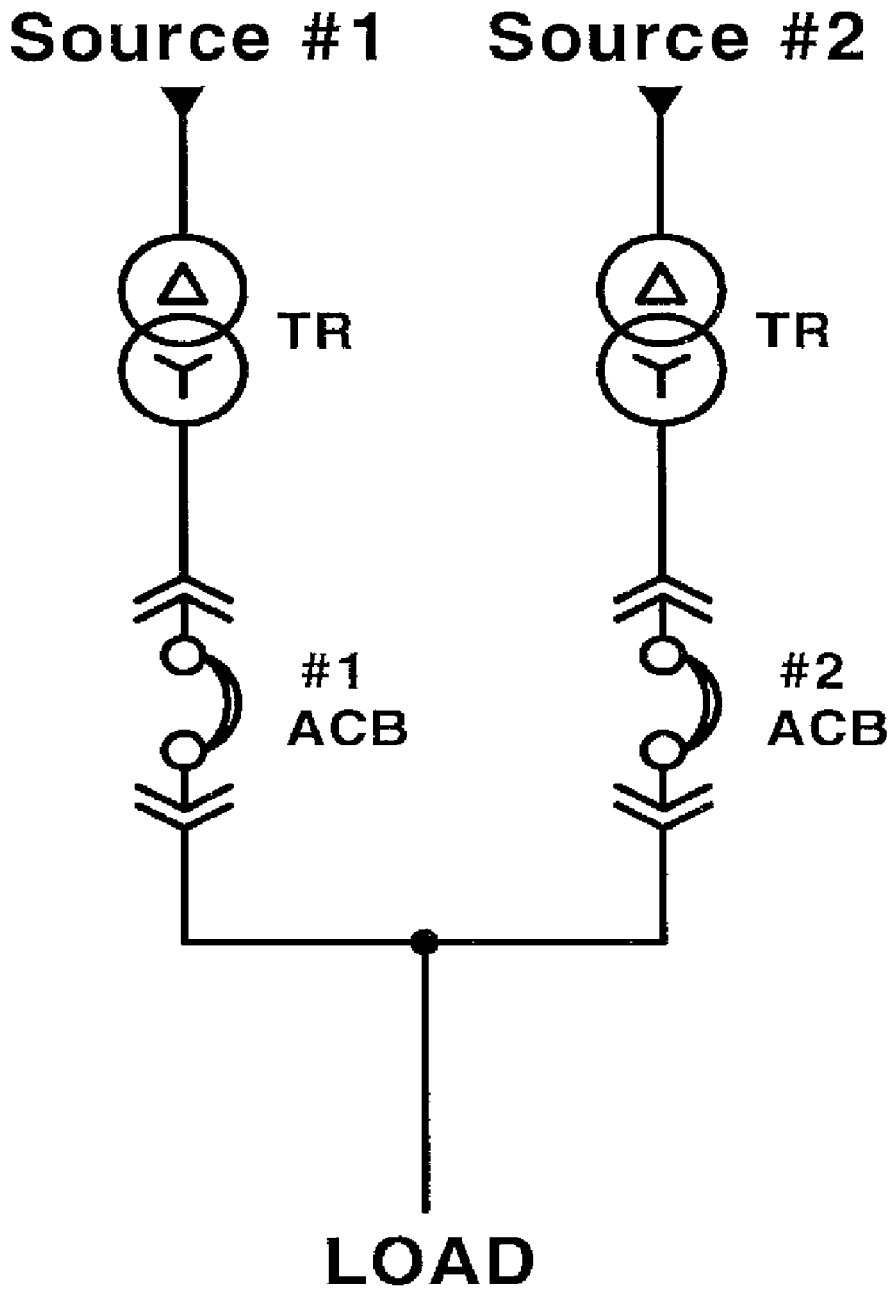
FIG. 1 is a circuit diagram of an automatic transfer switch with a double throw air circuit breaker according to the present invention.

As shown in FIG. 1, the commercial power wheel 209, the ratchet gear 208, the emergency power wheel 206 and the ratchet gear 205 rotate in a counterclockwise direction.

When the wheels 206 and 209 rotate, one side of each of the connection bars 301 and 303 engaged at the wheels 206 and 209 move along with the wheels 206 and 209. One side of the commercial power connection bar 303 moves in a direction of a rear side of the body 101, and one side of the emergency power connection rod 301 moves in a direction of a front side of the body 101. During the above procedures, the springs 302 and 304 are compressed.

As the wheels 206 and 209 rotate, the engaging shoulders 207 and 300 reach at the engaging lever 606 formed at both sides of the body 101 and installed at the bracket 602, the engaging lever 606 is caught by mans of the engaging shoulders 207 and 300. As a result, the wheels 206 and 209 and the ratchet gears 205 and 208 do not rotate.

The portions having no gear formation and corresponding to the engaging shoulders 207 and 300 of the wheels 206 and 209 in the outer surfaces of the ratchet gears 205 and 208 are formed. So, the wheels 206 and 209 and the ratchet gears 205 and 208 do not rotate even when the arm 202 reciprocates forwards and backwards as the motor 200 is driven, and the latches 203 and 204 escape from the latchet gears 205 and 208.

In the above state, when a pressing unit 305 of the trip unit is pressed, the protrusion 306 moves in a direction of a rear side of the body 101, and the upper side of the rotation lever 307 is pushed, and the upper side of the rotation lever 307 is moved in a direction of a rear side of the body 101. The upper end of the rotation lever 307 moves forwards, and the trip wheels 407 and 500 rotate by pulling the connection unit 401.

When the trip wheels 407 and 500 rotate, the trip shafts 408 and 501 rotate, and the front ends of each one side of the engaging unit 503 and 504 are inserted into the fixing grooves 409 and 502, and the front ends of the other sides of the engaging units 503 and 504 do not contact with the engaging shoulders 507 and 600 of the operation units 506 and 509. So, the shafts 102 and 103 are affected by means of the elastic forces of the springs 108 and 109.

Here, the commercial power connection unit 104 and the emergency power connection unit 105 are disconnected from a commercial power or an emergency power. In this state, a commercial power or an emergency power can be supplied. The process for supplying a commercial power will be described.

When the pressing unit 405 for a current use power is pressed, the rotation unit 603 inserted into the groove 404 rotate in a direction of a rear side of the body 101, and the fixing shaft 604 and the lever shaft 605 rotate, and the engaging lever 606 formed at the lever shaft 605 rotates, so that the locking state of the engaging shoulder 300 of the wheel 209 is released.

When the locking state of the wheel 300 is released, one side of the connection rod 303, which was moved in a direction of a rear side of the body 101 by an elastic force that the spring 304 tends to return to its original position, returns to its original position, and the wheel 209 strongly rotates in the clockwise direction, and the connection unit 121 rotates the commercial power shaft 102 in the clockwise direction, so that the connection unit 104 is connected with commercial power.

The pressing unit 402 moves in a backward direction, and the upper side of the rotation lever 307 moves in a backward direction. As a result, the lower side of the rotation lever 307 moves forwards and pulls the connection unit 401.

Since the connection unit 401 is connected with the power trip wheel 500 of the side B of the trip unit, the trip wheel 500 of the side B is rotated, and the emergency power connection unit 105 is disconnected from the emergency power, so that the emergency power of the side B is disconnected.

When the pressing unit of the side A is pressed, the commercial power is supplied, and the emergency power is disconnected.

When the pressing unit of the side B is pressed, the engaging lever 606 releases the locking state of the emergency power wheel 206, and the emergency power connection unit 105 is connected with an emergency power, and the rotation lever 307 pulls the connection unit 400, and the trip wheel 407 rotates, and the commercial power connection unit 104 is disconnected from the commercial power, so that the commercial power is disconnected.

Selective connection or disconnection of the commercial power connection unit 104 and the emergency power connection unit 105 is automatically performed in accordance with an electrical signal. The connection of disconnection may be performed by selectively pressing the commercial power pressing unit or the emergency power pressing unit. When both powers are needed to be disconnected for a certain maintenance, the pressing unit 305 of the trip unit is pressed, so that the commercial power connection unit 104 and the emergency power connection unit 105 are concurrently disconnected.

As described above, the present invention relates to an automatic transfer switch with a double throw air circuit breaker having an automatic rotation unit, a trip unit and a switching unit. With one apparatus, a commercial power or an emergency power may be selectively supplied. The manufacturing cost of the automatic transfer switch is low. When a certain error occurs in the commercial power supply, the commercial power is fast disconnected, and the emergency power is connected for thereby obtaining a reliable power supply while preventing accidents. The above operations are implemented by means of a motor, so that the operation and use are easier. In case of emergency situations, it is possible to fast disconnect the commercial power and preparatory power for thereby basically preventing a bid accident.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In an automatic transfer switch which includes ratchet gears rotating by means of an operation of a handle, connection rods which operate in sync with the ratchet gears with one side of each of the gears being connected with shafts having a plurality of connection units, springs which are installed at the connection rods, a switching means which is connected with one of the connection units and the other connection unit wherein when the switching means is connected with one of the connection units, the other connection unit is disconnected, and a trip means which is connected with the one of the connection units and the other connection unit and allows a neutral state by disconnecting the connection units, the automatic transfer switch with a double throw air circuit breaker, comprising:

a motor which is engaged at a lower end of a body with an eccentric roller being formed at a front end of a rotary shaft;

an automatic rotation means which operates by receiving power via an arm having latches at both sides of the arm and rotates the ratchet gears, with a longitudinal hole, which accommodates an eccentric roller forming one of the latches therein, being formed at one side of the arm, with the other side of the arm being engaged with the ratchet gears; and insulators which are engaged on the shafts, with the connection units being engaged at front sides of the insulators.

2. The switch of claim 1, wherein a wheel for inducing a rotational force is integrally provided at one side of each of the ratchet gears, so that the springs may be further provided with recovering forces.

3. The switch of claim 1, wherein said trip means comprises:

a pressing unit which is installed at a body and has a protrusion at both sides of the pressing unit;

a rotation lever which has an upper side contacting with one of the protrusions and rotates with respect to the rotation shaft;

trip wheels which are installed at both sides of a bracket and are rotatably engaged at trip shafts having fixing grooves;

operation units which are engaged at the shafts with one end of each of the operation units being provided with engaging shoulders, with the other end of each of the operation units being engaged with connection bars; and engaging units which are engaged at the bracket, with one side of each of the engaging units being extended from fixing grooves of the trip shafts, with the other side of each of the engaging units contacting with the engaging shoulders of the operation units.

4. The switch of claim 1, wherein said switching means comprises:

pressing units, with a groove being formed at one side of each of the pressing units, with a protrusion being formed at a side portion of the groove;

a rotation unit which is connected with a fixing shaft, with a front end of the rotation unit being inserted into the groove of the pressing units;

an engaging lever which is installed on a lever shaft connected with the fixing shaft; and wheels of which one side of each of the wheels is connected with the ratchet gears and rotates along with the ratchet gears, and the other side of each of the wheels is connected with the connection rods, with engaging shoulders being formed at one side of an outer surface of the wheels.

5. The switch of either claim 1 or claim 4, wherein bus bars connected with the connection units are connected with the connection unit of side A, a load connection unit and the connection unit of side B and are detachable from the connection units and are extended.

6. The switch of claim 1, wherein a protection apparatus is constructed via a relay with respect to an over load of a load, an open phase and less voltage for thereby implementing a circuit breaker.

* * * * *